United States Patent [19]

Matsuda

[11] Patent Number: 4,615,288

[45] Date of Patent: Oct. 7, 1986

[54] MECHANISM FOR DRAWING AN ELONGATED SEWN PRODUCT FROM A SEWING MACHINE

[75] Inventor: Yasuhiko Matsuda, Toyama, Japan

[73] Assignee: Yoshida Kogyo K. K., Tokyo, Japan

[21] Appl. No.: 709,653

[22] Filed: Mar. 8, 1985

[30] Foreign Application Priority Data

Mar. 9, 1984 [JP] Japan ..... 59-34393[U]

[51] Int. Cl.[4] ..... D05B 33/00; B65H 29/10

[52] U.S. Cl. ..... 112/121.29; 112/121.26; 271/85; 414/753; 198/468.2

[58] Field of Search ..... 112/121.29, 121.26; 271/85; 414/751, 753; 198/468.2

[56] References Cited

U.S. PATENT DOCUMENTS

| | | | |
|---|---|---|---|
| 3,618,546 | 11/1971 | Preston | 112/121.29 |
| 3,655,069 | 4/1972 | Gertsen | 414/751 |
| 3,903,818 | 9/1975 | Marforio | 112/121.26 |
| 3,951,400 | 4/1976 | Blessing et al. | 112/121.29 X |
| 4,062,309 | 12/1977 | Pollmeier et al. | 112/121.26 |
| 4,102,280 | 7/1978 | Hannemann | 112/121.26 |
| 4,258,637 | 3/1981 | Hannemann | 112/121.26 |
| 4,291,909 | 9/1981 | Coatantiec | 414/753 X |
| 4,460,083 | 7/1984 | Oyama | 271/85 X |

*Primary Examiner*—Henry S. Jaudon
*Assistant Examiner*—Andrew M. Falik
*Attorney, Agent, or Firm*—Hill, Van Santen, Steadman & Simpson

[57] ABSTRACT

A mechanism, for drawing an elongated sewn product from a sewing machine, has at least one gripper disposed downstream of the sewing machine for gripping a leading end of the sewn product. The gripper is reciprocable on a horizontal rail between a retracted or upstream position and an advanced or downward position. In the advanced position, the gripper is pivotally movable downwardly from the horizontal rail through a predetermined angle.

4 Claims, 6 Drawing Figures

MECHANISM FOR DRAWING AN ELONGATED SEWN PRODUCT FROM A SEWING MACHINE

BACKGROUND OF THE INVENTION

1. Field of the Invention:

The present invention relates to an apparatus for sewing an elongated article such as a curtain, a tent or a lady's dress. More particularly, the present invention relates to a mechanism for drawing an elongated sewn product from a sewing station.

2. Description of the Prior Art:

Various apparatus for sewing an elongated fabric article, such as a curtain, a tent or a lady's dress, are known in which an elongated sewn product is discharged from the apparatus by means of an assembly of rollers. However, a common problem with the prior apparatus is that the discharged sewn products would tend to stay in a disorderly fashion on the discharge side of a sewing station, which would often require the workman's hand to assist in discharging the sewn products in an orderly fashion, thus enabling only a limited rate of production. Yet, for drawing the elongated sewn product from the sewing station, a considerably long drawing mechanism is needed, which necessarily makes the whole apparatus objectionably large.

SUMMARY OF THE INVENTION

According to the present invention, an improved drawing mechanism has at least one gripper disposed downstream of a sewing machine for gripping a leading end of a sewn product. The gripper is reciprocable on a horizontal rail between a retracted or upstream position and an advanced or downstream position. In the advanced position, the gripper is pivotally movable downwardly from the horizontal rail through a predetermined angle.

It is therefore an object of the present invention to provide a relatively short mechanism for drawing an elongated sewn product from a sewing station by a distance equal to or greater than the length of the sewn product to be discharged, thus reducing the size of the entire apparatus to a minimum.

Another object of the invention is to provide a relatively short drawing mechanism in which the successive elongated sewn products can be discharged without staying in a disorderly fashion on the discharge side of the sewing machine.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
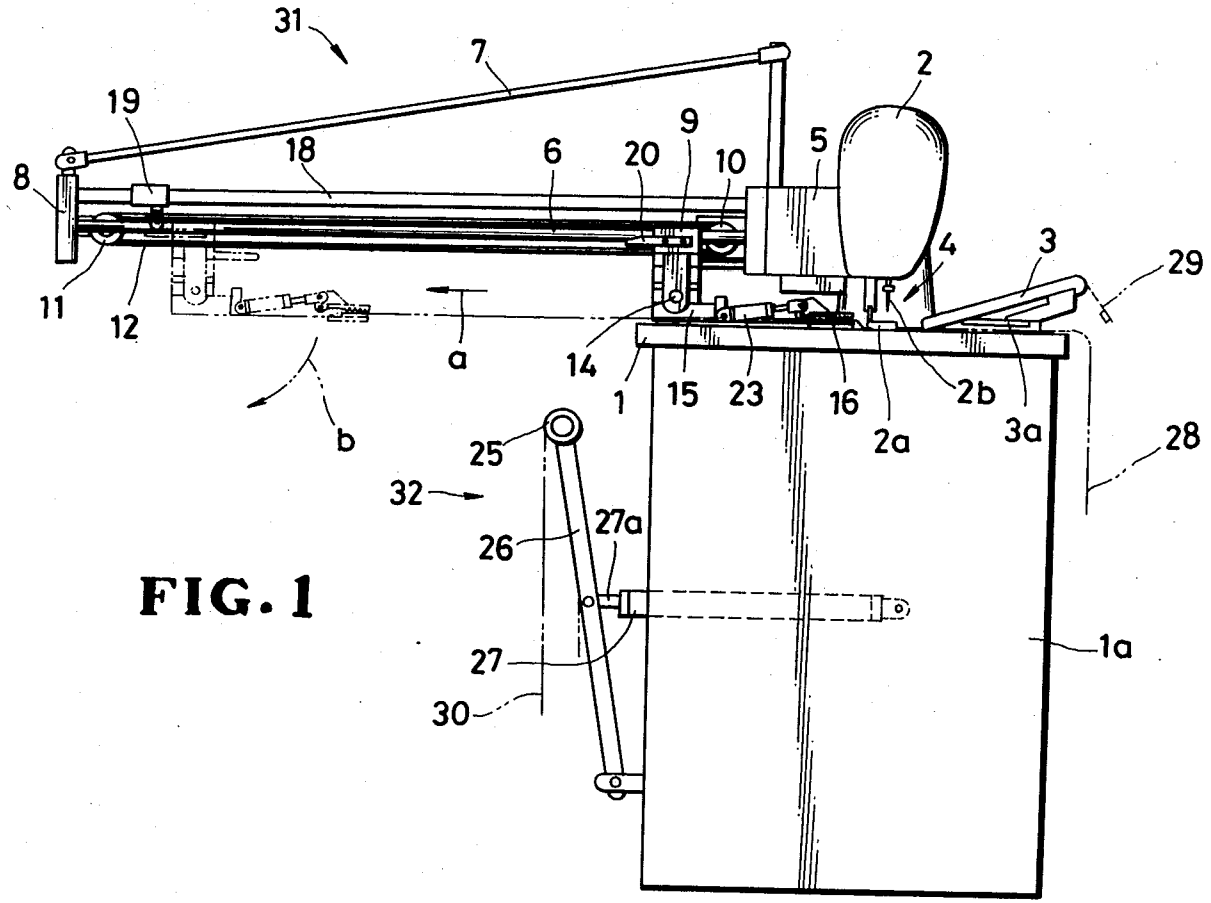
FIG. 1 is a side elevational view of a sewing apparatus having a sewn-product drawing mechanism embodying the present invention.

FIG. 1 shows an apparatus for sewing a slide fastener 29 to a pair of elongated fabric pieces 28, 28, e.g. of a lady's dress.

The sewing apparatus geverally comprises a table 1, a sewing machine 2 mounted centrally on the table 1 and defining a sewing station 4, a fabric guide 3*a* supported on the table 1 upstream of the sewing station 4, a slide-fastener guide 3 supported on the table 1 and disposed above the fabric guide 3*a*, a drawing mechanism 31 supported on the sewing machine 2 downstream of the sewing station 4, and a stacker 32 supported on a base 1*a* of the table 1 and disposed underneath the drawing mechanism 31.

The sewing machine 2 may be a conventional type on the market. The sewing machine 2 includes a presser foot 2*a*, a pair of feed dogs (not shown), and a pair of sewing needles 2*b*, 2*b*. Upon depression of a start button (not shown), the presser foot 2*a* is lowered and then the sewing of the slide fastener 29 and the fabric pieces 28 in "lock stitch" takes place. This lock-stitch sewing is followed by back-tucking, cutting of the sewing threads (not shown) and raising of the presser foot 2*a* in this order. The details of the sewing machine 2 itself are not pertinent here and its detailed description is omitted for clarity.

The fabric guide 3*a* includes a pair of transparent horizontal guide plates (only one shown in FIG. 1) spaced apart from the upper surface of the table 1 by a gap slightly larger than the thickness of the individual fabric piece 28. As the pair of fabric pieces 28, 28 are supplied to the sewing station 4, each fabric piece 28 passes through the gap between the corresponding guide plate and the table 1.

The slide-fastener guide 3 includes an elongated flanged guide plate sloping downwardly toward the sewing station 4 for guiding the slide fastener 29 in open position to the sewing station 4.

The purposes of the drawing mechanism 31 is not only to quickly discharge the sewn product 30, i.e. the slide fastener 29 with the fabric pieces 28, 28, but to keep the tension of the slide fastener 29 and the fabric pieces 28, 28 constant during the sewing.

Figure 2:
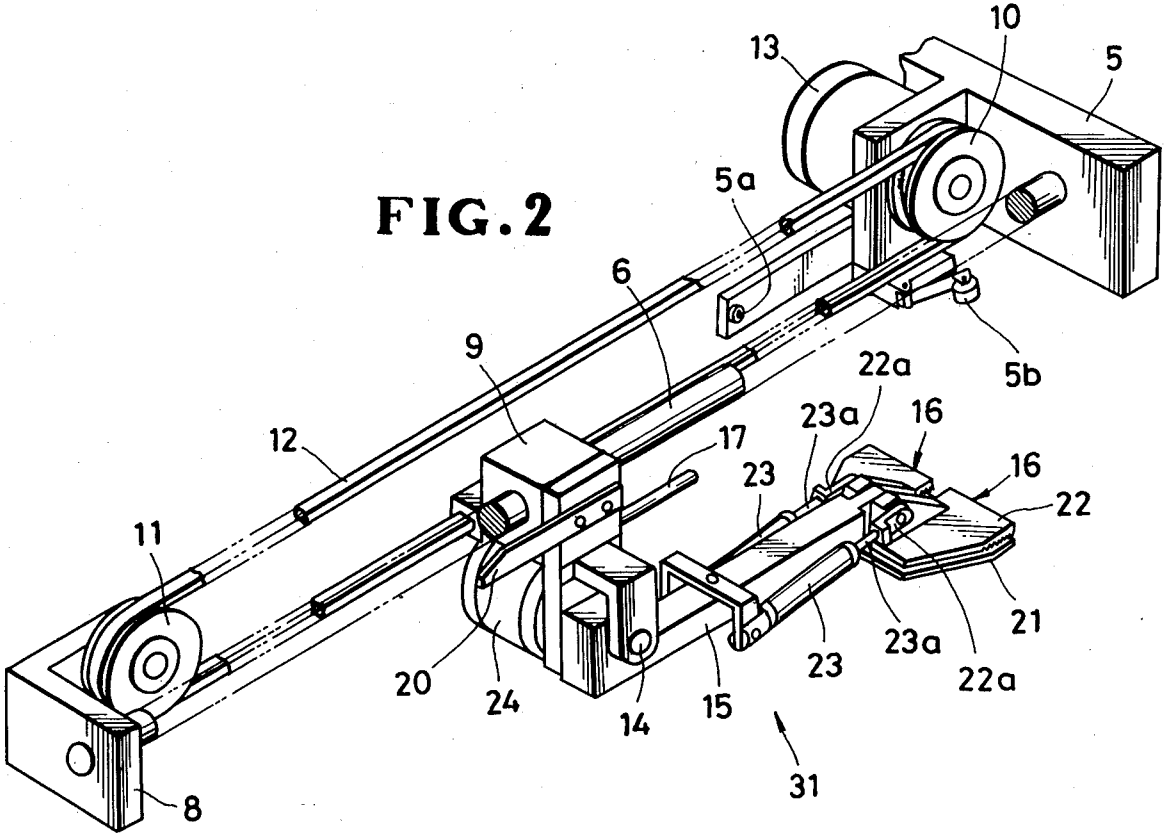
FIG. 2 is an enlarged perspective view, with parts broken away, of the drawing mechanism of FIG. 1.
Figure 3:
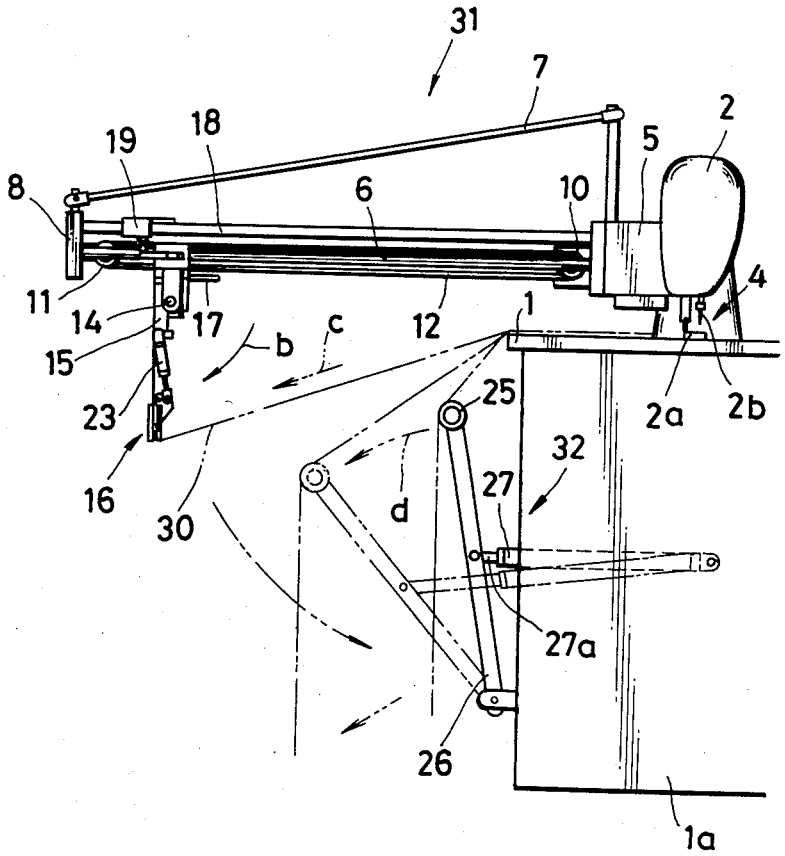
FIG. 3 is a fragmentary side elevational view similar to FIG. 1, showing the drawing mechanism in lowered position.

As shown in FIGS. 1, 2 and 3, the drawing mechanism 31 includes a pair of laterally spaced grippers 16, 16, each gripper 16 being composed of an upper grip member 22 and a lower grip member 21. As best shown in FIG. 2, the lower grip member 21 is secured to an arm 15 mounted on a shaft 14 which is rotatably supported on a slide 9. The upper grip member 22 is pivotally connected to the arm 15 near the downstream end of the lower grip member 21. The upper grip member 22 is also connected to an air cylinder 23 via a link 22*a* which is connected to a piston rod 23*a* of the air cylinder 23. The two air cylinders 23, 23 are pivotally mounted on the arm 15 remotely from the grippers 16, 16. Upon energization and de-energization of the two air cylinders 23, 23, each piston rod 23*a* projects and is retracted to close and open the respective grippers 16.

The drawing mechanism 31 also includes a holder 5 which is fixed to the downstream side of the sewing machine 2 and from which a guide rail 6 extends horizontally in the direction of discharging the sewn product 30, a downstream end of the guide rail 6 being fixed to a bracket 8 supported by a hanger rod 7 (FIGS. 1 and 3). The slide 9 is slidably mounted on the guide rail 6 and is fixed to an endless belt 12 wound around a pair of pulleys 10, 11 rotatably mounted on the holder 5 and the bracket 8, respectively. The pulley 10 is operatively connected to a servo motor 13 (FIG. 2) for driving the slide 9 forwardly (downstream) and backwardly (upstream) and also for changing the speed of movement of the slide 9 depending on the load.

The backward or upstream movement of the slide 9 is limited by a stop 17 projecting therefrom and engageable with the holder 5; thus the backward travel of the two grippers 16, 16 terminates in a retracted position close to the sewing station 4. At that time, the approach of the slide 9 is detected by a proximity switch 5*a* (FIG. 2) which issues a signal to reduce the rate of rotation of the servo motor 13, and the arrival of the slide 9 is detected by a limit switch 5*b* (FIG. 2) which has an actuator engageable with the stop 17 and which is responsive to this engagement to issue a signal to terminate the rotation of the servo motor 13. The forward or downstream movement of the slide 9 is limited by a contact member 20 extending therefrom and engageable with an actuator of a limit switch 19 (FIGS. 1 and 2) which is adjustably mounted on a support rod 18 extending between the holder 5 and the bracket 8 in parallel relation to the guide rail 6. When the actuator of the switch 19 is hit by the contact member 20, the limit switch 19 produces a signal to stop rotation of the servo motor 13, thus terminating the forward movement of the slide 9. As a result, the forward movement of the two grippers 16, 16 terminates in an advanced position, which is adjustable by changing the position of the limit switch 19 on the support rod 18. The stroke of the slide 9 is considerably shorter than the length of the sewn product.

As shown in FIG. 2, a drive 24, such as a motor or an air cylinder, is operatively connected to the shaft 14 for turning the same through a predetermined angle, e.g. 90° as in the illustrated embodiment. In response to clockwise turning (FIG. 1), the arm 15 is angularly movable about the shaft 14 in the direction of an arrow b from the phantom-line position (horizontal) of FIG. 1 to the solid-line position (vertical) of FIG. 3, whereupon the piston rod 23*a* of each air cylinder 23 assumes a retracted position to open the respective gripper 16 for releasing the sewn product 30. This arrangement is particularly advantageous in that in spite of the short stroke of the slide 9, a relatively long sewn product can be discharged without staying in a disorderly fashion on the discharge side of the sewing machine 2. Accordingly it is possible to reduce the length of the drawing mechanism 31 and thus the size of the entire sewing apparatus to a minimum.

As shown in FIGS. 1 and 3, the stacker 32 is disposed underneath the drawing mechanism 31 for receiving the successive sewn products 30 (released from the grippers 16, 16) one over another and for discharging a stack of the sewn products 30 out of the sewing apparatus when such stack reaches a predetermined amount.

The stacker 32 includes a generally T-shaped hanger having a horizontal transverse pipe 25 connected to an upper end of a support arm 26 pivotally mounted on the base la of the table 1. An air cylinder 27 is pivotally supported on the base 1*a*, and a piston rod 27*a* of the air cylinder 27 is pivotally connected to the support arm 26 at a midportion thereof. In timed relation to the forward movement of the two grippers 16, 16, the piston rod 27*a* of the air cylinder 27 projects to cause the stacker 26 to pivotally move in the direction of an arrow d in FIG. 3 from a retracted (solid-line) position to an advanced (phantom-line) position where the sewn product 30 released from the grippers 16, 16 is received on the transverse pipe 25. Thereafter, when the piston rod 27*a* of the air cylinder 27 is retracted, the stacker 32 is returned to its original or retracted position, with the sewn product 30 hanging from the transverse pipe 25 as shown in FIG. 1.

In operation, before the sewing work is started, a pair of fabric pieces 28, 28 and a slide fastener 29 are introduced into the sewing station 4 in superimposed condition. At that time, the slide 9 and thus the grippers 16, 16 are disposed in retracted or upstream position close to the sewing station 4 (FIG. 1), each gripper 16 being open. The stacker 31 is also disposed in retracted or upstream position.

When a start button (not shown) of the sewing machine 2 is actuated, the presser foot 2*a* and the sewing needles 2*b*, 2*b* are lowered to start sewing. As the sewing progresses, each fabric piece 28 and the corresponding stringer of the slide fastener 29 are advanced leftwardly in FIG. 1 by the action of the non-illustrated feed dogs of the sewing machine 2. The arrival of the leading end portions of the fabric pieces 28, 28 and of the slide fastener 29 at the grippers 16, 16 is detected by a photosensor (not shown) disposed at a suitable position in the sewing machine 2. This photosensor is responsive to this detection to issue a signal to the air cylinder 23, 23, whereupon the piston rod 23*a* of each air cylinder 23 projects to cause the respective gripper 16 to grip the sewn end portions of the respective fabric piece 28 and of the corresponding stringer of the slide fastener 29.

Figure 4A:
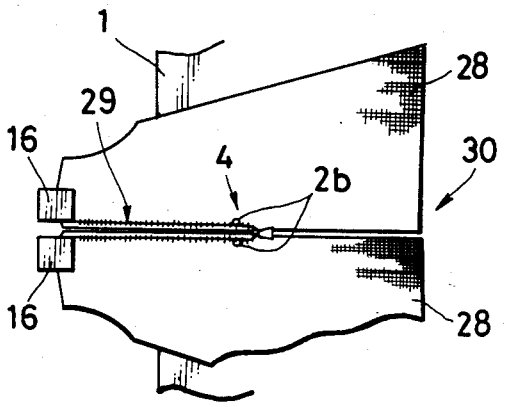
FIGS. 4A, 4B and 4C are plan views illustrating the manner in which a sewn product is progressively drawn from a sewing station.
Figure 4B:
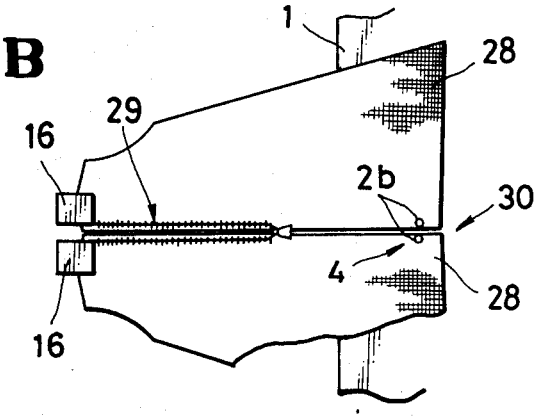

The slide 9 is then moved forwardly as the pulley 10 is driven, by the servo motor 13 (FIG. 2), to rotate counterclockwise. Thus the grippers 16, 16 pull the sewn product 30 away from the sewing station 4 in the direction of an arrow a (FIG. 1) at a predetermined speed substantially equal to the speed in which the sewn product 30 is advanced by the feed dogs (not shown) of the sewing machine 2, as shown in FIGS. 4A and 4B.

Immediately before a slide fastener slider (not numbered) disposed at the bottom end portion of the slide fastener 29 reaches the sewing station 4, a slider detector (not shown) issues a signal to the sewing machine 2 to stop the lock-stitch sewing and then to start backtucking. The sewing threads are cut, and the presser foot 2*a* is raised to terminate the operation of the sewing machine 2.

After the sewing operation of the sewing machine 2 is stopped, the slide 9 and thus the grippers 16, 16 continue to pull the sewn product 30 until the contact member 20 on the slide 9 hits the actuator of the limit switch 19 which then issues a signal to the servo motor 13 (FIG. 2) to stop the clockwise rotation of the pulley 10 (FIGS. 1 and 3). FIG. 4B shows the grippers 16, 6 having reached their advanced position, with the trailing end portion of the sewn product 30 remaining in the sewing station 4.

Figure 4C:
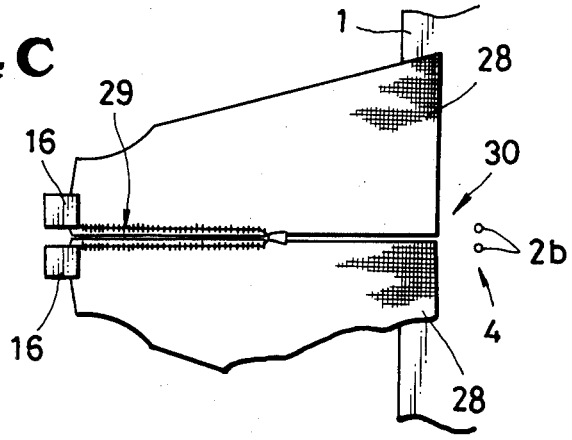

In their advanced position, the grippers 16, 16 are pivotally moved, by the drive 24 (FIG. 2), in the direction of an arrow b from the horizontal (phantom-line) position of FIG. 1 to the vertical (solid-line) position of FIG. 3, thereby drawing the sewn product 30 in the direction of an arrow c (FIG. 3). As a result, the sewn product 30 has been removed from the sewing station 4, but the trailing end portion of the sewing product 30 remains on the upper surface of the table 1, as shown in FIG. 4C.

Then the piston rods 23*a*, 23*a* of the two air cylinders 23, 23 are retracted to open the grippers 16, 16, thereby releasing the sewn product 30. The sewn product 30 thus released falls partly by gravity and partly by inertia onto the transverse pipe 25 of the stacker 26 in advanced position, as shown in FIG. 3. At that time, the trailing end portion of the sewn product 30 is removed from the upper surface of the table 1.

Finally, the grippers 16, 16 in open position are returned to their horizontal (phantom-line) position of FIG. 1 and thence to their original or retracted position close to the sewing station 4. The stacker 31 is also returned to its original or retracted position. Thus a single cycle of sewing operation has been completed, and the sewing apparatus is now in condition for start of the next cycle of the sewing operation.

With the drawing mechanism 31, it is possible to discharge even a relatively long sewn product from the sewing station 4 reliably in an orderly fashion, without increasing the length of the drawing mechanism, partly because after their relatively short horizontal travel, the grippers 16, 16 are pivotable downwardly from the horizontal path of travel to thereby increase the entire stroke of drawing the sewn product.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A mechanism for drawing an elongated sewn product from a sewing station defined by a sewing machine, said mechanism comprising:

(a) a fixed horizontal guide rail;

(b) a slide supported on said guide rail and movable therealong;

(c) at least one gripper pivotally mounted on said slide for gripping a leading end of the sewn product;

(d) means for moving said slide, with said gripper assuming a horizontal position, along said guide rail between a retracted position in which said gripper is disposed adjacent to the sewing station and an advanced position in which said gripper is disposed remotely from the sewing station;

(e) means, responsive to arrival of said slide at said advanced position, for angularly moving said gripper downwardly through a predetermined angle from said horizontal position to a lowered position;

(f) means for closing said gripper to grip the leading end of the sewn product while said slide is in said retracted position, and also for opening said gripper, upon arrival of the latter at said lowered position, to release the leading end of the sewn product;

(g) said angularly-moving means including (1) a shaft rotatably supported by said slide, (2) an arm mounted on said shaft and supporting said gripper, and (3) a drive operatively connected to said shaft for turning the latter through said predetermined angle;

(h) said gripper including (1) a lower grip member fixed to a free end of said arm, and (2) an upper grip member pivotally connected to said arm; and (i) said closing-and-opening means including at least one air cylinder pivotally supported by said arm and having a piston rod pivotally connected to said upper grip member.

2. A mechanism for drawing an elongated sewn product from a sewing station defined by a sewing machine, said mechanism comprising:

(a) a fixed horizontal guide rail;

(b) a slide supported on said guide rail and movable therealong;

(c) at least one gripper pivotally mounted on said slide for gripping a leading end of the sewn product;

(d) means for moving said slide, with said gripper assuming a horizontal position, along said guide rail between a retracted position in which said gripper is disposed adjacent to the sewing station and an advanced position in which said gripper is disposed remotely from the sewing station;

(e) means, responsive to arrival of said slide at said advanced position, for angularly moving said gripper downwardly through a predetermined angle from said horizontal position to a lowered position;

(f) means for closing said gripper to grip the leading end of the sewn product while said slide is in said retracted position, and also for opening said gripper, upon arrival of the latter at said lowered position, to release the leading end of the sewn product;

(g) said angularly-moving means including (1) a shaft rotatably supported by said slide, (2) an arm mounted on said shaft and supporting said gripper, and (3) a drive operatively connected to said shaft for turning the latter through said predetermined angle; and (h) said drive including a motor.

3. A mechanism for drawing an elongated sewn product from a sewing station defined by a sewing machine, said mechanism comprising:

(a) a fixed horizontal guide rail;

(b) a slide supported on said guide rail and movable therealong;

(c) at least one gripper pivotally mounted on said slide for gripping a leading end of the sewn product;

(d) means for moving said slide, with said gripper assuming a horizontal position, along said guide rail between a retracted position in which said gripper is disposed adjacent to the sewing station and an advanced position in which said gripper is disposed remotely from the sewing station;

(e) means, responsive to arrival of said slide at said advanced position, for angularly moving said gripper downwardly through a predetermined angle from said horizontal position to a lowered position;

(f) means for closing said gripper to grip the leading end of the sewn product while said slide is in said retracted position, and also for opening said gripper, upon arrival of the latter at said lowered position, to release the leading end of the sewn product;

(g) said angularly-moving means including (1) a shaft rotatably supported by said slide, (2) an arm mounted on said shaft and supporting said gripper, and (3) a drive operatively connected to said shaft for turning the latter through said predetermined angle; and (h) said closing-and-opening means including at least one air cylinder pivotally supported by said arm and having a piston rod pivotally connected to said upper grip member.

4. A drawing mechanism according to claim 3, said drive including a motor.

* * * * *